US009196416B2

(12) United States Patent
White

(10) Patent No.: US 9,196,416 B2
(45) Date of Patent: Nov. 24, 2015

(54) BOBBINS FOR GAPPED TOROID INDUCTORS

(71) Applicant: Hamilton Sundstrand Corporation, Charlotte, NC (US)

(72) Inventor: Adam M. White, Belvidere, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 14/167,276

(22) Filed: Jan. 29, 2014

(65) Prior Publication Data

US 2015/0042437 A1 Feb. 12, 2015

Related U.S. Application Data

(60) Provisional application No. 61/863,145, filed on Aug. 7, 2013.

(51) Int. Cl.

| | |
|---|---|
| ***H01F 27/30*** | (2006.01) |
| ***H01F 17/06*** | (2006.01) |
| ***H01F 27/24*** | (2006.01) |
| ***H01F 27/32*** | (2006.01) |
| ***H01F 5/02*** | (2006.01) |
| ***H01F 27/28*** | (2006.01) |
| *H01F 3/14* | (2006.01) |

(52) U.S. Cl.

CPC ..... *H01F 27/325* (2013.01); *H01F 5/02* (2013.01); *H01F 27/2895* (2013.01); *H01F 3/14* (2013.01)

(58) Field of Classification Search

CPC ..... H01F 3/14; H01F 17/06; H01F 17/062; H01F 27/30; H01F 27/324; H01F 27/325; H01F 30/16; H01F 2005/02; H01F 2005/022; H01F 2005/025; H01F 2005/027

USPC ..... 336/178, 196, 212, 198, 208

See application file for complete search history.

(56) References Cited

U.S. PATENT DOCUMENTS

| | | | | |
|---|---|---|---|---|
| 4,975,672 | A | 12/1990 | McLyman | |
| 5,128,645 | A * | 7/1992 | Suda | 336/110 |
| 6,300,857 | B1 * | 10/2001 | Herwig | 336/229 |
| 2014/0218158 | A1 * | 8/2014 | Miyamoto | 336/198 |

FOREIGN PATENT DOCUMENTS

| | | | |
|---|---|---|---|
| DE | 10042573 | A1 * | 2/2002 |
| EP | 2061043 | A1 | 5/2009 |
| JP | 2008098209 | A | 4/2008 |

OTHER PUBLICATIONS

Extended European Search Report dated Jan. 7, 2015 for Application No. 14/176,875.4-1556.

* cited by examiner

*Primary Examiner* — Mangtin Lian

(74) *Attorney, Agent, or Firm* — Locke Lord LLP; Scott D. Wofsy; Joshua L. Jones

(57) ABSTRACT

A bobbin for spacing windings around an inductor core includes an interior spacer defining an exterior surface for coupling interior spacer with an annular inductor core and an interior facing surface opposing the exterior surface for receiving inductor windings. The interior spacer has a thickness profile between the exterior and interior facing surfaces for spacing the windings inward from the inductor core to reduce magnetic fringe flux effects on the windings. An inductor body includes an inductor core coupled to bobbin. A wound inductor includes windings wrapped around the inductor body formed by the inductor core and bobbin.

19 Claims, 3 Drawing Sheets

Fig. 1
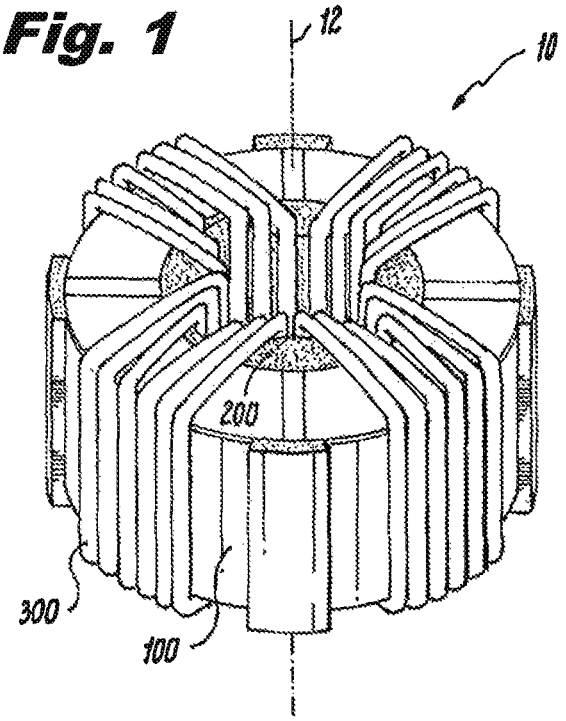
Fig. 2
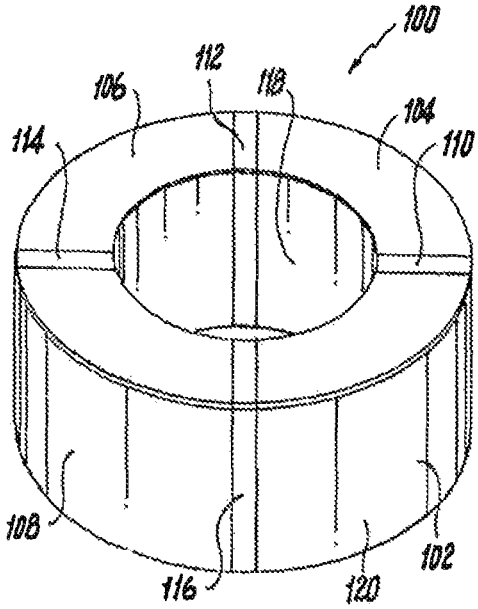
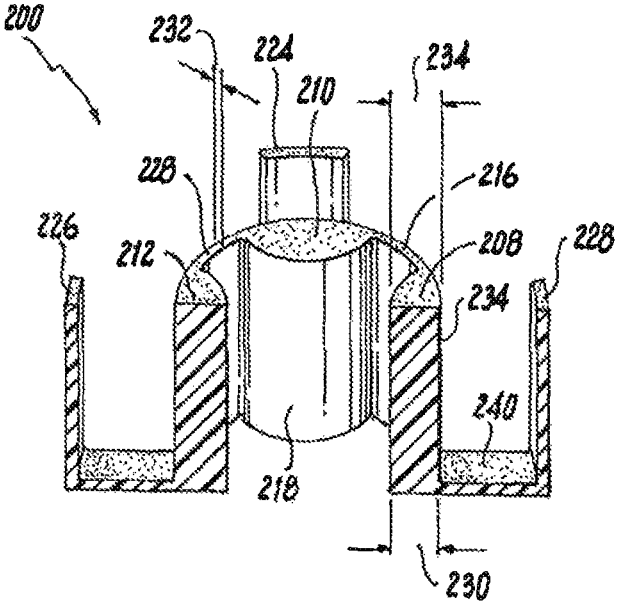
Fig. 3A
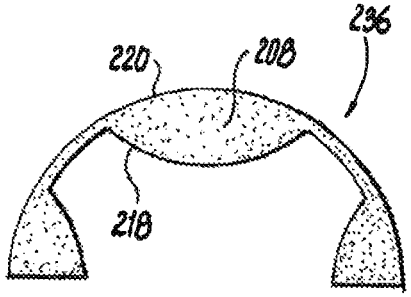
Fig. 3B

BOBBINS FOR GAPPED TOROID INDUCTORS

CROSS-REFERENCE TO RELATED APPLICATIONS

This application claims the benefit of priority to U.S. Provisional Patent Application No. 61/863,145 filed Aug. 7, 2013 which is incorporated by reference herein in its entirety.

BACKGROUND OF THE INVENTION

1. Field of the Invention

The present disclosure relates generally to wound inductors, and more particularly to annular wound inductors with segmented magnetic cores.

2. Description of Related Art

Wound inductors typically include a magnetic core constructed from a magnetic material and a wire wound about the core. The magnetic field of the core interacts with current flowing through the wire windings, operating to resist change in the current flow by storing energy in the magnetic field of the coil. The stored energy is a function of the core material, core geometry, and number of wire windings wrapping around the core.

Inductor cores typically include at least one gap extending between one or more core segments. Introducing a gap into the core tilts or shears the core magnetic dynamic hysteresis, making it possible to use the core at higher current and control inductance. Gaps also give rise to fringe flux. Fringe flux is magnetic flux that departs the surface of the inductor body near core gaps. Fringe flux can interact with current flowing through windings portions positioned near the core gaps, affecting inductor performance by inducing eddy currents and/or causing localized heating. Fringe flux can be particularly problematic for wound inductors used in high frequency power converters where parasitic eddy currents can reduce converter efficiency.

Conventional wound inductors have generally been considered satisfactory for their intended purpose. However, there is a need in the art for wound inductors that are tolerant of core gaps and associated fringe flux. There also remains a need for wound inductors that are easy to make and use. The present disclosure provides a solution to these needs.

SUMMARY OF THE INVENTION

The subject disclosure is directed to a new and useful bobbin for spacing windings around an inductor core. The bobbin includes an interior spacer that defines an exterior surface for coupling the bobbin to the inductor core and an opposed interior facing surface for receiving inductor windings. The interior spacer has a thickness profile between the interior and exterior surfaces for spacing windings inward of the inductor core to reduce magnetic fringe flux effects on the windings. It is contemplated that the bobbin can include a plurality of interior spacers circumferentially coupled by circumferential segments forming an annulus with a contoured interior facing surface. The interior spacer can have a maximum thickness greater than that of the circumferential segment. The interior spacer can also define an interior facing convex surface for positioning winding portions radially inward of the exterior surface of the bobbin.

In embodiments, the bobbin includes an exterior spacer disposed radially outward of the interior spacer for circumferentially grouping exterior winding portions between core gaps to reduce magnetic fringe flux effects on the windings. A base portion or radially extending flange can couple respective interior and exterior spacers, rendering the spacers integral with one another. The bobbin can also include a plurality of exterior spacers disposed radially outward of respective interior spacers.

An inductor body can be formed by coupling the bobbin to one or both of the interior and outer surfaces of the inductor core. The core gaps can extend radially outward from the interior spacers and radially inward from the exterior spacers. In certain embodiments, the core has four segments and the core interior and exterior surfaces define a toroid-shaped core.

A wound inductor is formed using the bobbin and a toroid-shaped inductor core having core segments separated by gaps. Windings are wrapped around the bobbin and inductor core. Exterior winding segments contact the core outer surface between core gaps. Interior winding segments contact the interior facing surface such that they are positioned radially inward of the gap by the thickness profile of the interior spacer. The exterior winding portions can be adjacent to one another as a group, and the group can be positioned equidistant between opposed gaps on end of the core segment. In embodiments, fringe flux associated with the gap lies within the bodies of the interior and exterior spacers.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 1 is a plan view of a wound inductor, showing the winding arrangement;

FIG. 2 is a perspective view of the inductor core of the wound inductor of FIG. 1, showing the inductor core shape;

FIG. 3A is a cross-sectional perspective view of the bobbin of the wound inductor of FIG. 1, showing the bobbin shape;

FIG. 3B is partial plan view of the bobbin of the wound inductor of FIG. 1, showing a thickness profile of an interior spacer;

DETAILED DESCRIPTION OF THE PREFERRED EMBODIMENTS

Figure 4:
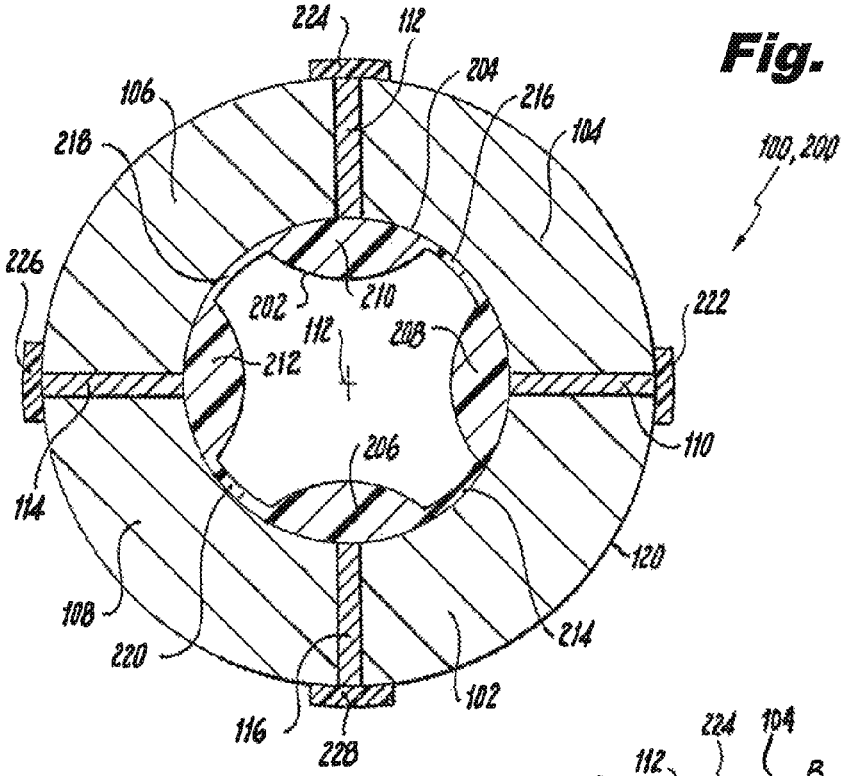
FIG. 4 is a cross-sectional plan view of the inductor core of the wound inductor of FIG. 1, showing the bobbin coupled to the inductor core.

Reference will now be made to the drawings wherein like reference numerals identify similar structural features or aspects of the subject disclosure. For purposes of explanation and illustration, and not limitation, a view of an exemplary wound inductor is shown in FIG. 1 and is designated generally by reference character 10. Other embodiments of the wound inductor in accordance with the disclosure, or aspects thereof, are provided in FIGS. 2-7, as will be described. Wound inductor 10 can be used for power converters, such as in aircraft motor controllers for example.

Wound inductor 10 includes an inductor body 100/200 with an inductor core 100 coupled to a bobbin 200 disposed about an axis 12. Inductor core 100 is constructed from a magnetic material, such as an iron alloy type tape, ferrite or a powder and is toroid-shaped. Bobbin 200 is constructed from a plastic material or any other suitable material, and may be formed by injection molding. Windings 300 are constructed from a conductive material, such as copper or aluminum for example. Windings 300 may be fabricated from a single length of copper wire configured and adapted to be electrically connected at one end to a switching power supply and at the other end to a load to prevent fast changes in current at the load. This provides filtering, such as for electromagnetic interference and/or power quality requirements. Windings 300 wrap around inductor body 100/200 helically with portions of the windings running through an interior of the inductor body 100/200 and about an exterior of inductor body 100/200. In the illustrated embodiment wound inductor 10 includes 24 turns. As will be appreciated by one of skill in the art, wound inductor 10 can include a suitable number of turns sized and arranged for a given application.

With reference to FIG. 2, inductor core 100 of wound inductor 10 is shown. Inductor core 100 extends radially between interior surface 118 and exterior surface 120, has an annular shaped body, and is interrupted by circumferential spaced gaps 110, 112, 114, and 116. Gaps 110, 112, 114, and 116 divides inductor core 100 into a plurality of circumferentially adjacent core segments 104, 106, 108, and 110. As illustrated in FIG. 2, inductor core 100 includes a first core segment 102, a second core segment 104, a third core segment 106, and a fourth core segment 108. First core segment 102 is circumferentially adjacent to second core segment 104 and separated therefrom by a first gap 110. Second core segment 104 is circumferentially adjacent to third core segment 106 and separated therefrom by a second gap 112. Third core segment 106 is circumferentially adjacent to fourth core segment 108 and separated therefrom by a third gap 114. Fourth core segment 108 is circumferentially adjacent to first core segment 102 and separated therefrom by a fourth gap 116. Interior and exterior surfaces 118 and 120 define a toroid-shaped inductor core 100 that provides a nearly continuous magnetic circuit. As will appreciated by one of skill in the art, gaps 110, 112, 114, and 116 are physical and magnetic discontinuities filled with a suitable non-magnetic material, such as a resin and glass mixture for example.

With reference to FIG. 3A, bobbin 200 for spacing windings 300 around inductor core 100 is shown. Bobbin 200 has an interior spacer 210 defining an exterior surface 220 and an opposed interior facing surface 218. Exterior surface 220 is for coupling interior spacer 218 with inductor core 100, such as with an adhesive or using an interference fit for example. Interior facing surface 218 is for receiving windings 300. Interior spacer 210 has a thickness profile 234 between exterior surface 220 and interior surface 218 for spacing windings 300 inward from inductor core 100 to reduce magnetic fringe flux effects on windings 300. A first interior spacer 208 couples to a second interior spacer 210 through a circumferential segment 216, thereby being circumferentially spaced apart second interior spacer 210. Circumferential segment 216 allows first and second interior spacers 208 and 210 to couple with inductor core 100 as an integral body, simplifying assembly on inductor body 100/200. As will be appreciated by those skilled in the art, interior segments 208 and 210 can also couple to inductor core 100 independently.

Interior spacer 208 has a maximum radial thickness 230. Circumferential segment 216 has a radial thickness 232. Thickness 230 is greater than thickness 232. This provides inward positioning of windings near fringe flux radially inward, away from fringe flux proximate to inductor core segments. As illustrated in FIG. 3B, embodiments of bobbin 200 can have a thickness profile that defines an interior facing convex surface 218 defined by thickness profile 234 for positioning interior windings radially inward of exterior surface 220 of interior spacer 208. This provides for matching the inward positioning of windings near core segment gaps radially inward at distances conforming to a distribution of fringe flux near the core segment gaps, thereby efficiently limiting the amount of the inductor core occupied by the interior segments of the bobbin.

With continued reference to FIG. 3A, bobbin 200 also includes an exterior spacer 228 disposed radially outward of interior spacer 208 for grouping exterior winding portions 304 (shown in FIG. 7) on exterior surface 120 of inductor core 100, reducing fringe flux effects on windings 300. Exterior spacer 228 is integral with interior spacer 208, coupling through a base portion 240. As will be appreciated, other coupling members arranged between interior and outer spacers 224 and 208 are possible within scope of the present disclosure including lateral wall spacers occupying gaps between the circumferentially adjacent core segments. Embodiments of wound inductor 10 having integral internal and external spacers aids in assembly as bobbin 200 serves as a jig for positioning core segments during assembly of inductor body 100/200.

With reference to FIG. 4, inductor body 100/200 is shown. Bobbin 200 is as described above and includes first interior spacer 208, second interior spacer 210, third interior spacer 212, and fourth interior spacer 206. First interior spacer 208 is coupled to second interior spacer 210 by first circumferential segment 216. Second interior spacer 210 is coupled to third interior spacer 212 by a second circumferential segment 218. Third interior spacer 212 is coupled to fourth interior spacer 206 by a third circumferential segment 220. Fourth interior spacer 206 is coupled to first interior 208 by a fourth circumferential segment 214. Inductor core 100 is disposed radially outward of the bobbin interior spacers and circumferential segments, and is interrupted by circumferential gaps 110, 112, 114 and 116. Inductor core 100 couples to interior surface 218 of bobbin 200 such that interior spacers 208, 210, 212 and 206 are disposed radially inward of respective gaps 110, 112, 114 and 116. Bobbin 200 also includes a first exterior spacer 222, a second exterior spacer 224, a third exterior spacer 226, and a fourth exterior spacer 228. Exterior spacers 222, 224, 226 and 228 couple to exterior surface 120 of inductor core 100 such that each exterior spacer is arranged radially outward of one of gap 110, 112, 114 and 116. In the illustrated embodiment, first interior spacer 208 is radially inward and first exterior spacer 222 is radially outward of first gap 110. Second interior spacer 210 is radially inward and second exterior spacer 224 is radially outward of second gap 112. Third interior spacer 212 is radially inward and third exterior spacer 226 is radially outward of third gap 114. Fourth interior spacer 206 is radially inward and fourth exterior spacer 228 is radially outward of fourth gap 116. Providing interior spacers 208, 210, 212 and 214 allows for positioning windings on interior surface of bobbin 200 radially inward and substantially beyond fringe flux associated with gaps of inductor core 100, thereby improving winding current flow characteristics. Providing exterior spacers 222, 224, 226 and 228 allows for positioning windings on exterior surface 120 of inductor core 100, circumferentially away from fringe flux associated with gaps of inductor core 100, further improving current flow windings 300. As will be appreciated, inductor body 100/200 can have any number of gaps and corresponding interior and exterior spacers as suitable for a given application.

Figure 5:
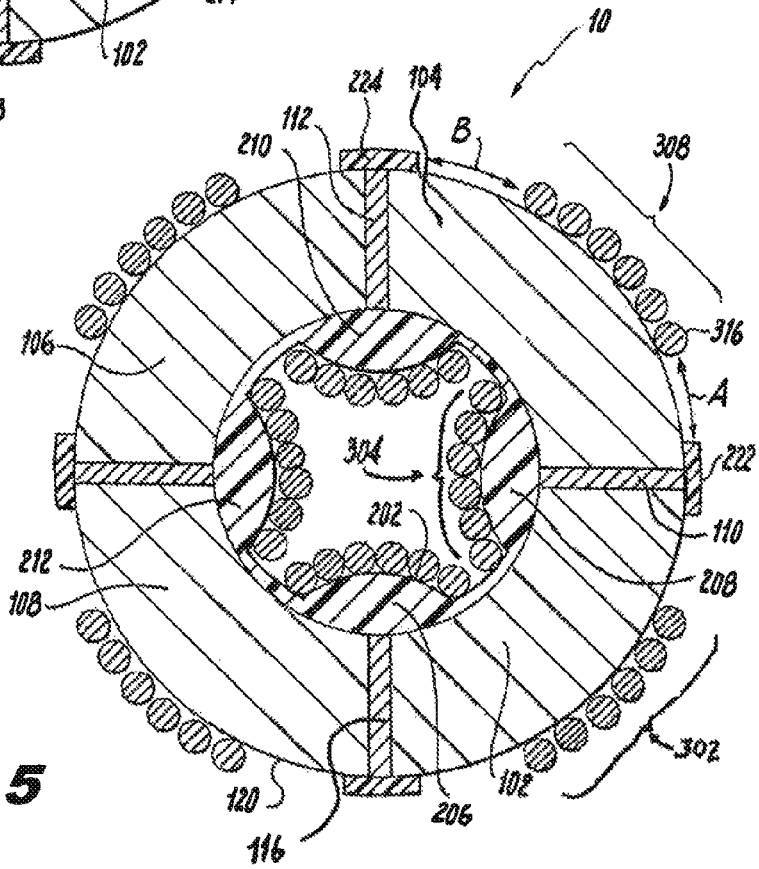
FIG. 5 is a cross-sectional plan view of the wound inductor of FIG. 1, showing interior and exterior portions of the windings.

With reference to FIG. 5, wound inductor 10 is shown in a cross-sectional plan view. Wound inductor 10 includes inductor core 100 and bobbin 200 as described above, and additionally includes windings 300. Windings 300 wrap around inductor core 100 and bobbin 200 in a helical path. Inductor core 100 is toroid-shaped and includes first, second and third core segments 102, 104 and 106. First core segment 102 is separated from second core segment 104 by first gap 110. Second core segment 104 is separated from third core segment 106 by second gap 112. Interior spacers 208 and 210 are disposed radially inward of first and second gaps 110 and 112. Exterior spacers 222 and 224 are disposed radially outward of first and second gaps 110 and 112. Windings 300 wrap around inductor core 100 and bobbin 200 such that external winding portions 302 and 308 are positioned over exterior surface 120 on surface portions bounding first and second core segments 102 and 104, and circumferentially away from gaps 110, 112, and 116. Internal winding portion 304 is positioned radially inward of first spacer 208 and radially inward from gap 110.

Internal winding portion 304 is positioned radially inward of first gap 110 by the thickness profile of first interior spacer 208. This positions internal winding portion 304 beyond fringe flux associated with of gap 110. External winding portions 302 and 308 are positioned circumferentially away from gaps 110, 112, and 116. This positions external winding portions 302 and 308 beyond fringe flux associated with gaps 110, 112, and 114. As will be appreciated by one of skill in the art, positioning external winding portions 302 and 308 circumferentially away from gaps 110, 112, and 116 configures windings 300 such that wound inductor 10 has a relatively small diameter and device footprint. As will also be appreciated, the winding arrangement shown in FIG. 5 is suitable for wound inductors having at least one circumferential gap and one or more core segments.

Figure 6:
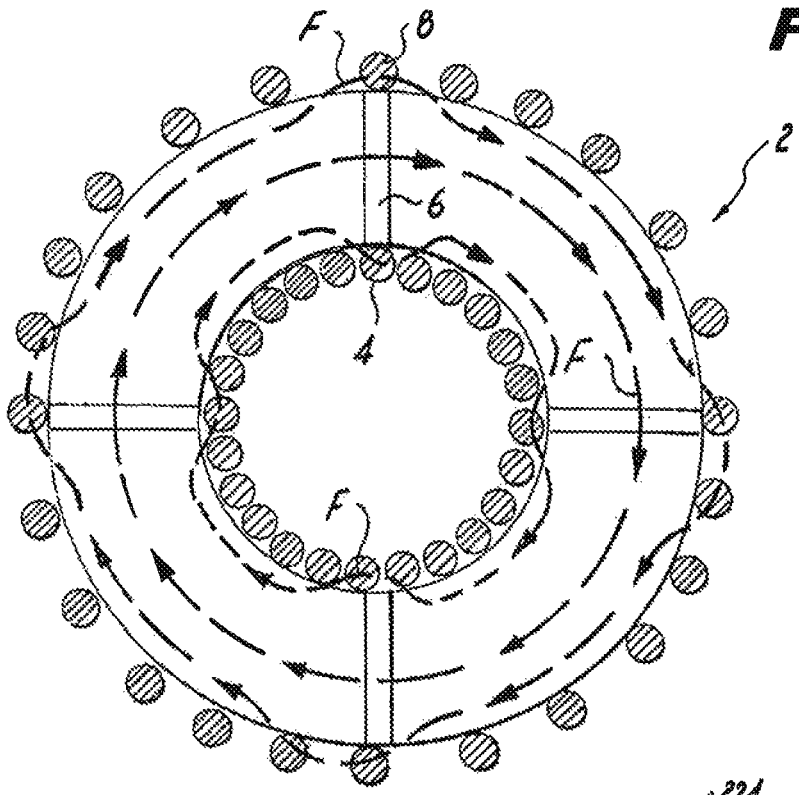
FIG. 6 is cross-sectional plan view of a conventional wound inductor, showing the positional relationship of windings and fringe flux.

With reference to FIG. 6, a conventional wound inductor 2 is shown in cross-section with magnetic flux lines F illustrated. Magnetic flux leaks from gaps between core segments, departing from the physical surfaces of the core and causing fringe flux thereabout. Windings turns positioned near the gaps, such as winding turn 4 and 8, may be within the fringe flux as is illustrated in exemplary fashion near gap 6. As will be appreciated, current flowing through these winding turns can be affected by the fringe flux near the gap, adversely impacting the performance of wound inductor 2.

Figure 7:
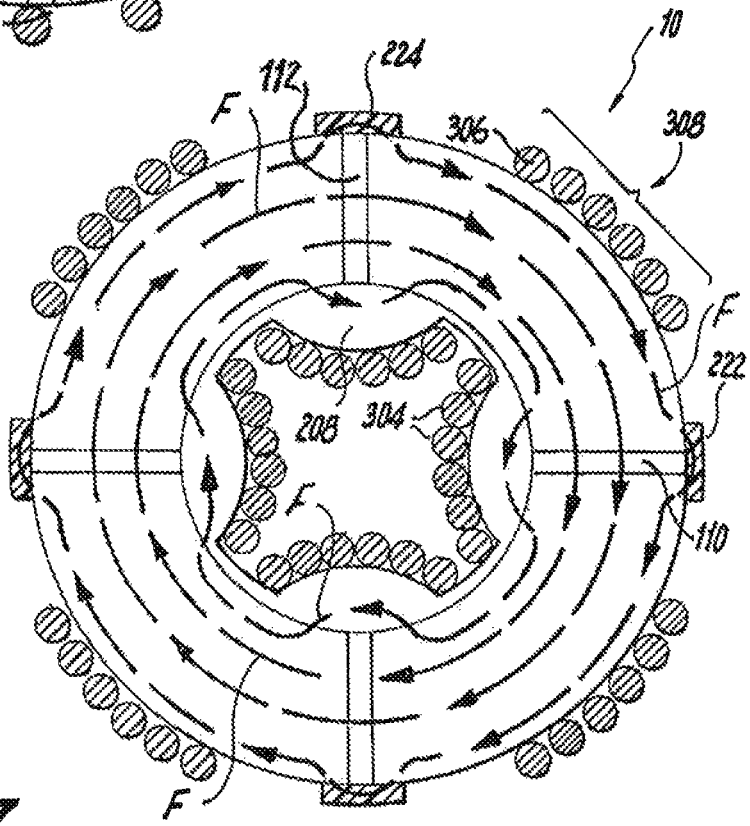
FIG. 7 is a cross-sectional plan view of the wound inductor of FIG. 1, showing the positional relationship of windings and fringe flux for embodiments of the wound inductor described herein.

With reference to FIG. 7, an embodiment of wound inductor 10 as described herein is shown in cross-section with field flux lines F illustrated. Magnetic flux and fringe flux leakage distribution of wound inductor 10 is similar to that of wound inductor 2. In contrast to wound inductor 2, interior spacers (208 identified only for clarity purposes) position interior winding segments 304 radially inward of fringe flux near gap 110. Exterior spacers (222 and 224 identified only for clarity purposes) position exterior winding segments 308 circumferentially away from fringe flux associated with gaps 110 and 112. This provides for current flow through windings 300 with less fringe flux impact and enhances operation of wound inductor 10. As will be appreciated, exterior spacers 222 and 224 can circumferentially bound winding segment 308, centering winding segment 308 equidistantly between gaps 110 and 112, thereby substantially reducing the fringe flux effect on windings 300 due to adjacent gaps 110 and 112.

Current applied to a wound inductor is ideally uniform within each winding turn about the core. The current flowing through the winding turns heats the inductor resistively due to the resistance of the conductive material from which the winding turns are constructed. Fringe flux in the vicinity of core gaps induces additional localized eddy current in winding turns in the vicinity of the gaps. This additional current generates additional heat in winding turns disposed within the fringe flux, adversely impacting performance of the inductor. By positioning turns away from the fringe flux the eddy current and associated localized heating is reduced, thereby improving inductor performance.

The methods and systems of the present disclosure, as described above and shown in the drawings, provide would inductors with segmented cores that reduce winding heating caused by fringe flux associated with gaps separating the core segments. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. An inductor assembly, comprising:

a bobbin with an interior spacer, defining:

an exterior surface for coupling the interior spacer with an inductor core; and an opposed interior facing surface for receiving inductor windings, wherein the interior spacer has a convex surface defined between the exterior and interior surfaces thereof;

the inductor core being disposed radially outward of the bobbin and interrupted with a circumferential gap, the interior spacer being coupled to an interior surface of the inductor core and disposed radially inward of the gap; and first and second winding portions being disposed over the convex surface defined by the interior spacer and offset radially by the thickness profile of the interior spacer, the thickness profile offsetting the first winding portion radially inward by a distance greater than a radial offset of the second winding portion.

2. An inductor assembly as recited in claim 1, wherein the inductor core is toroid-shaped.

3. An inductor assembly as recited in claim 1, further comprising an exterior spacer coupled to an exterior surface of the inductor core and disposed radially outward of the gap.

4. An inductor assembly as recited in claim 1, wherein the inductor core has four core segments separated by circumferential gaps, and wherein the interior spacers and exterior spacers are respectively disposed radially inward and outward of the gaps.

5. An inductor assembly as recited in claim 1, further comprising a circumferential segment coupled to the interior spacer for circumferentially spacing a second interior spacer from the interior spacer.

6. An inductor assembly as recited in claim 5, wherein the interior spacer has a maximum thickness that is greater than that of the circumferential segment.

7. An inductor assembly as recited in claim 5, wherein the thickness profile of the interior spacer defines an interior facing convex surface for positioning interior windings radially inward of the exterior surface of the interior spacer.

8. An inductor assembly as recited in claim 1, further comprising an exterior spacer disposed radially outward of the interior spacer for grouping exterior winding portions and reducing magnetic fringe flux effects on the windings.

9. An inductor assembly as recited in claim 8, wherein the interior spacer and exterior spacer are integral with one another.

10. An inductor assembly as recited in claim 9, further comprising a base portion coupling the interior spacer and exterior spacer.

11. An inductor assembly as recited in claim 8, further comprising a second exterior spacer circumferentially offset from the exterior spacer for positioning winding segments between the exterior segments for reducing magnetic fringe flux effects on the windings.

12. A wound inductor, comprising:

a bobbin with an interior spacer, defining:

an exterior surface for coupling the interior spacer with an a toroid-shaped inductor core; and an opposed interior facing surface for receiving inductor windings, wherein the interior spacer has a convex thickness profile between the exterior and interior surfaces thereof;

wherein the inductor core is coupled to the bobbin and includes first and second inductor core segments separated by a circumferential gap; and first and second winding portions wrapped around an outer surface of the first inductor core segment and the interior facing surface of the interior spacer, the first and second winding portions being positioned radially inward of the first circumferential gap by the convex thickness profile of the interior spacer, wherein the first and second winding portions are disposed over the convex surface defined by the interior spacer and offset radially by the thickness profile of the interior spacer, the thickness profile offsetting the first winding portion radially inward by a distance greater than a radial offset of the second winding portion.

13. A wound inductor as recited in claim 12, further comprising a third inductor core segment separated from the second inductor core segment by a second circumferential gap.

14. A wound inductor as recited in claim 13, further comprising first and second exterior spacers respectively disposed radially outward of the first and second circumferential gaps.

15. A wound inductor as recited in claim 14, further comprising exterior winding portions wrapped around the outer surface of the first inductor core and circumferentially disposed between the first and second exterior spacers.

16. A wound inductor as recited in claim 15, wherein each of the exterior winding portions are adjacent another exterior winding portion.

17. A wound inductor as recited in claim 16, wherein the adjacent exterior winding portions for a winding group equidistantly between the first and second exterior spacers.

18. A wound inductor as recited in claim 12, wherein a portion of a fringe flux field associated with the first circumferential gap is within a body of the interior spacer.

19. A wound inductor as recited in claim 14, wherein a portion of a fringe flux field associated with the first circumferential gap lies within a body of the exterior spacer.

* * * * *